US007579534B1

(12) United States Patent
Ryan

(10) Patent No.: US 7,579,534 B1
(45) Date of Patent: Aug. 25, 2009

(54) PORTED BEVEL FOR MUSICAL INSTRUMENT AND METHOD FOR MAKING THE SAME

(75) Inventor: Kevin Ryan, Westminster, CA (US)

(73) Assignee: Kevin Ryan Guitars, Inc., Westminster, CA (US)

( * ) Notice: Subject to any disclaimer, the term of this patent is extended or adjusted under 35 U.S.C. 154(b) by 0 days.

(21) Appl. No.: 12/228,571

(22) Filed: Aug. 13, 2008

Related U.S. Application Data

(60) Provisional application No. 60/964,687, filed on Aug. 13, 2007.

(51) Int. Cl.
*G10D 3/00* (2006.01)

(52) U.S. Cl. ..... 84/291; 84/267

(58) Field of Classification Search ..... 84/267, 84/291

See application file for complete search history.

(56) References Cited

U.S. PATENT DOCUMENTS

| | | | | | |
|---|---|---|---|---|---|
| 886,137 | A | * | 4/1908 | Lang | 84/291 |
| D186,826 | S | * | 12/1959 | Fender | D17/14 |
| 4,178,827 | A | * | 12/1979 | Mallory | 84/291 |
| 4,317,402 | A | | 3/1982 | McPherson, Sr. | |
| 4,334,452 | A | * | 6/1982 | Morrison et al. | 84/723 |
| D270,841 | S | * | 10/1983 | Peavey | D17/20 |
| D286,299 | S | * | 10/1986 | Peavey | D17/20 |
| 4,632,003 | A | | 12/1986 | Kopp | |
| 5,567,894 | A | * | 10/1996 | Shiomi | 84/291 |
| 5,952,591 | A | * | 9/1999 | Thurman | 84/267 |
| 6,060,650 | A | | 5/2000 | McPherson | |
| 6,653,538 | B1 | * | 11/2003 | Wells | 84/291 |
| 7,169,991 | B2 | * | 1/2007 | Ralbovsky | 84/291 |
| 7,301,085 | B2 | * | 11/2007 | Wyman | 84/291 |
| 7,420,107 | B2 | * | 9/2008 | Parker et al. | 84/267 |
| 7,449,624 | B2 | * | 11/2008 | Boute | 84/291 |
| 2004/0060417 | A1 | * | 4/2004 | Janes et al. | 84/291 |
| 2004/0182221 | A1 | * | 9/2004 | Burrell | 84/291 |
| 2007/0006710 | A1 | * | 1/2007 | Chen | 84/291 |
| 2008/0110318 | A1 | * | 5/2008 | Fox | 84/267 |

OTHER PUBLICATIONS

Inventor's Web site: www.ryan.guitars.com/theguitars/Ordering/Bevel%20Flutes/Bevel%20Flutes.htm, viewed Jun. 13, 2009. Although the feature is already marketed, it was not disclosed prior to his priority date.*

* cited by examiner

*Primary Examiner*—Jeffrey Donels
*Assistant Examiner*—Robert W Horn
(74) *Attorney, Agent, or Firm*—James M. Duncan; Klein, DeNatale, et al.

(57) ABSTRACT

In a musical instrument, such as a flat top guitar, having a sound chamber defined by a back, sides, and a soundboard, a beveled portion is generally placed in the bass side of the lower bout of the instrument. The beveled portion has one or more openings, or flutes, which are small, tube-like openings, half-rounded apertures or other penetrations extending from the interior to the exterior of the sound chamber. The bevel flutes are visually pleasing, and emit sound waves generally toward the ear of the musician.

13 Claims, 6 Drawing Sheets

PORTED BEVEL FOR MUSICAL INSTRUMENT AND METHOD FOR MAKING THE SAME

CROSS-REFERENCE TO RELATED APPLICATION

U.S. Provisional Application No. 60/964,687 for this invention was filed on Aug. 13, 2007, for which application this inventor claims domestic priority.

BACKGROUND OF THE INVENTION

The present invention generally relates to stringed musical instruments and more particularly to a stringed instrument, such as an acoustic guitar, comprising a sound chamber, or body, in which sound waves generated by the plucked strings are amplified by the vibrations of the materials forming the sound chamber and emitted from the sound chamber. For musical instruments, such as flat-topped acoustic guitars, the sound chamber has a front (also referred to as the soundboard), back, and sides. For some of these instruments, the strings are attached on one end to a head at the end of a neck extending from the sound chamber, and attached at the other end to a bridge which is attached to the soundboard. The flat-topped acoustic guitar is so identified because its soundboard is generally flat, as opposed to an arched top guitar which, as suggested by the name, has an arching top with three dimensional characteristics. The term flat-topped acoustic guitar includes both steel string acoustic guitars as well as nylon string classical guitars.

Under the traditional design of a flat-topped guitar, the soundboard has a single opening for the emission of sound waves, which opening is disposed beneath the strings of the instrument, the opening being located centrally with respect to each side of the instrument.

When the strings vibrate, the vibrations travel through the bridge to the soundboard, such that the entire soundboard vibrates. The rest of the sound chamber amplifies the vibrations of the soundboard, with the sound waves primarily emitted from the soundhole.

In the case of acoustic guitars, the sound chamber generally comprises a top, known as the soundboard, a back, and sides. The lower bout is the large rounded bottom of a traditional guitar and the upper bout is the smaller, rounded and convex shape at the top. Under traditional design, the shape of the sound chamber of acoustic guitars is in the shape of a number "8", with the upper half, i.e., the upper bout, being smaller than the bottom half, i.e., the lower bout. The upper bout and lower bout are separated by the "waist" of the guitar, which is the concave transition between the upper and lower bouts. For traditional designs, the sound hole is located almost entirely in the upper bout of the instrument.

For the typical right handed guitar player, the upper bout of the guitar is adjacent to the player's left arm, and the lower bout is adjacent to the player's right arm. The left hand is utilized for fingering notes on a fingerboard (also referred to as the "fretboard"), where the fingerboard is disposed on the neck. The right hand is utilized for picking or strumming the strings. For the remainder of this description, it will be assumed that the guitar is a "right handed" guitar, i.e., built to be played by a right-handed person. However, correlating the description for a left-handed guitar only requires the assumption that the right hand is utilized for fingering the notes and the left hand is utilized for picking or strumming the strings.

The sides of the guitar may, for purposes of description, be identified with respect to the strings. The treble strings of the instrument are on the side of the instrument facing downward as it is played in the conventional manner, while the bass strings are on the side of the instrument generally facing upward as the instrument is played. Using the strings as a point of reference, the sides of a guitar may be referred to as the treble side and the bass side. With respect to the string orientation described above, the side of the guitar facing downward while being played is considered the treble side of the instrument and the side of the guitar facing upward is considered as the bass side of the instrument. The upper bout therefore may be further described as having a treble side upper bout and a bass side upper bout. Likewise, the lower bout may be further described as having a bass side lower bout and a treble side lower bout. The bass and treble sides of the lower bout meet at the bottom center of the guitar, where the meeting sides of the lower bout are glued to an an internal structure known as the "tailblock."

Under the traditional design for guitars, the exterior of the sound chamber is symmetric, where the treble side and bass side are mirror images of one another. However, over the years, instrument makers have modified the traditional design. One of the most common of these modifications, which results in an asymmetrical sound chamber, has been to fashion a "cut-away" into the treble side of the upper bout and upper portion of the soundboard adjacent to the neck on the treble side to allow the player greater access to the portions of the fingerboard adjacent to the body of the guitar. Other modifications have also been made, such as placing the sound hole in a different position than directly under the strings. As another modification, some instrument makers have placed bevels in various portions of the instrument, such as where the soundboard of the instrument joins the sides. Under the traditional design, the soundboard and sides of the instrument are at a right angle to each other, defining a common edge. This common edge may have a binding material, such a wood, plastic, or other trim, which protects the soundboard and side from impact damage. Some instrument makers "soften" this common edge by forming a rounded transition section from the side to the soundboard, forming a beveled edge (i.e. a bevel) for a portion of the common edge.

The inventor herein has invented a structural feature referred to as the "Ryan bevel" which has since been utilized and/or modified by others practicing the guitar making art. The Ryan bevel generally comprises an approximate 45 degree chamfer on the bass side lower bout. The Ryan bevel feathers in just above the bass-side waist and feathers out just beyond the centerline of the guitar at the tailblock area. The Ryan bevel has some acoustic advantages but it also creates greater comfort for the player since the player's right arm is resting on a chamfered, wide surface rather than against the relatively sharp corner of the guitar where the sides and soundboard of a conventional acoustic guitar meet.

Another modification made in recent years to acoustic flat-topped guitars has been the placing of an opening or cutout in the bass side upper bout of the guitar, where this opening is referred to as a "soundport". The soundport, as with the soundhole beneath the strings in the soundboard, provides an emission means for the sound waves generated by the strings as amplified by the sound chamber. For soundports located in the usual position on the bass side upper bout, sound waves emitted from the soundport are directed toward the face of the guitar player.

The known soundports present several problems and disadvantages. First, placing a soundport in the side of the instrument can result in diminished structural strength. For example, the sides of a guitar typically have a wall thickness ranging from 0.060" to 0.090", with about 0.075" being the most common thickness. Given this relatively thin wall, and the continuous load imposed on a guitar body by the string tension—approximately 180 pounds for a steel string guitar—the structural integrity of the load-bearing components of the instrument is always a concern. However, when a side has one or more cutouts for the soundports, the structural integrity may be adversely impacted.

One method of resolving this problem is to place a reinforcement member or other structure within the interior of the sound chamber, such as thicker backing on the interior side of the bout in which the soundport will be placed. However, this method has its own disadvantages. Utilizing a reinforcement member in this manner has the disadvantage of adding to the weight of the instrument and/or adversely impacting the acoustic properties of the sound chamber. Adding structural reinforcement on the inside of the instrument utilizes additional materials and is time consuming, thereby resulting in greater manufacturing expense. A reinforcement member can also create additional stresses on the side of the instrument, because the additional piece of wood glued to the side will not always shrink and expand at the same rate as the side material, which can create stresses and possible cracks in the side during relative humidity fluctuations.

Another problem presented by the known soundports is that when the soundports are located in the upper bout of the instrument, they are located in a portion of the instrument which is not as acoustically active as other portions of the sound chamber, such as in the lower bout behind and/or adjacent to the bridge.

The orientation of the known soundports is typically directed upward into the face of the player, with the axis of the soundport generally perpendicular to the front or soundboard of the instrument. It is to be appreciated that because an audience is typically located at the front of the instrument, the axis of a soundport located in the upper bout of the instrument will be perpendicular to the general direction of the audience. Moreover, depending upon the position in which the player holds the instrument, this location is not optimal for directing sound waves to the player's ear.

SUMMARY OF THE INVENTION

The disclosed apparatus resolves the problems identified above for placing soundports in a musical instrument such as a flat-topped guitar. An embodiment of the apparatus comprises one or more "flutes" (defined as small, tube-like openings, half-rounded or elliptical apertures or other penetrations extending from the exterior to the interior of the sound chamber) placed in a bevel fashioned in the lower half of the instrument. At this location the instrument is acoustically active and already has increased wall thickness for structural integrity. Unlike the commonly known soundports which typically have axes at a right angle to the soundhole or the soundboard, the axes of the soundports disclosed herein are at an angle of less than ninety degrees to the soundboard, thereby directing sound waves more toward the audience and, depending upon the playing position of the player, more toward the player's ear than a soundport disposed in the upper bout of the instrument.

The soundports disclosed herein are placed within a bevel member which, by its normal construction, is sufficiently reinforced such that the removal of material to create the soundports does not adversely impact the structural integrity of the instrument. For the positions utilized by most musicians, the disclosed ports will be positioned adjacent to the arm utilized for playing the strings with fingers or pick. For example, for a right-handed musician, the disclosed soundports will likely be positioned near the musicians right arm. This position allows the right-handed musician to selectively utilize his or her arm as a mute over some or all of the soundports, thereby providing the musician yet another technique for coloring or modifying the acoustic output of the instrument.

The disclosed invention includes a method of installing the soundports in the bevel member. A handheld air turbine motor driving a cutting head or bit may be oriented such that the resulting openings are elliptical in shape, and an axis defined by each soundport is not perpendicular to the soundboard of the instrument, such that the sound waves are not emitted directly forward from the instrument.

DETAILED DESCRIPTION OF THE EMBODIMENTS

Figure 1:
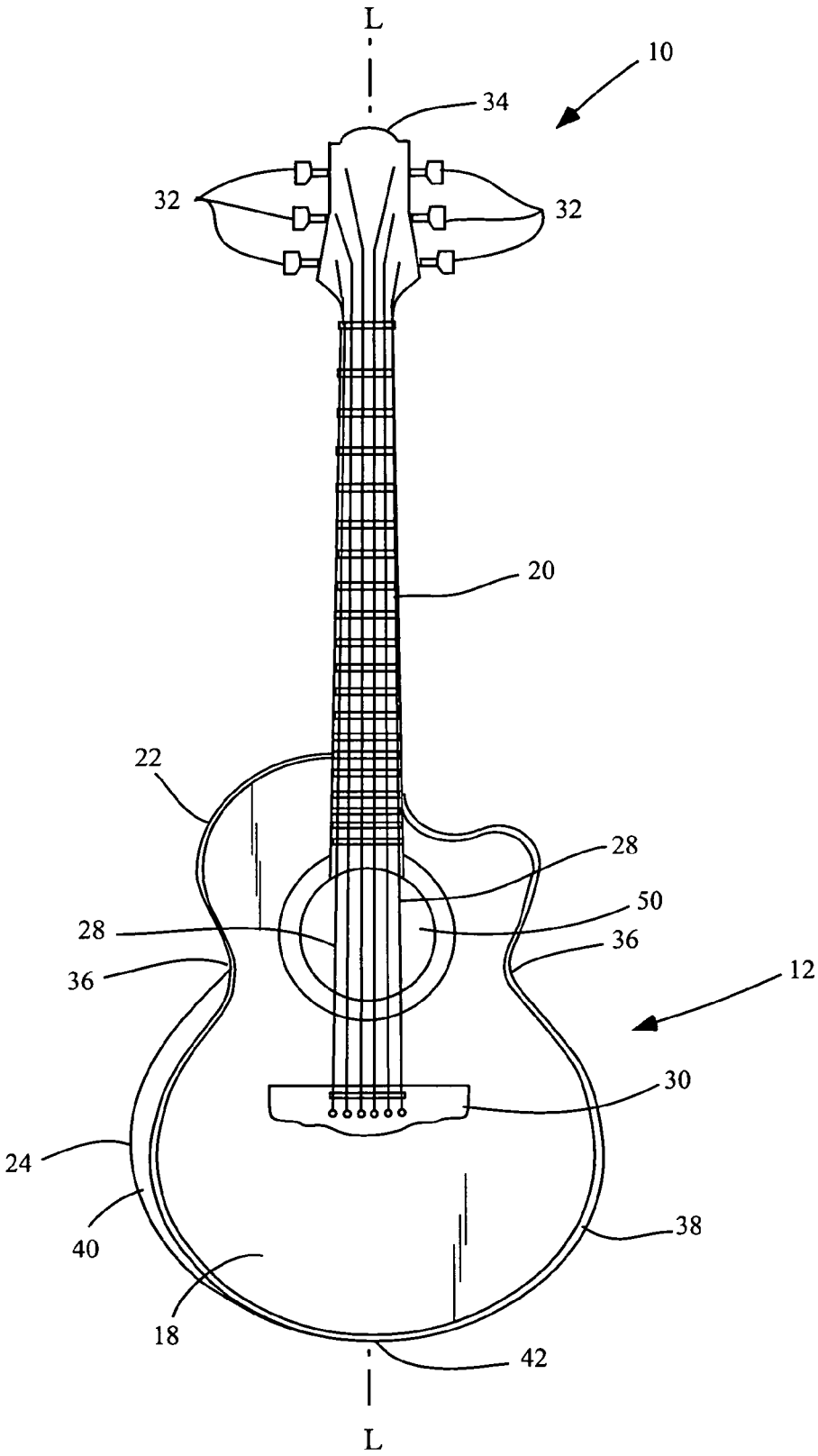
FIG. 1 shows a front view of a musical instrument, in this case a guitar, having a bevel in the bass side of the lower bout.
Figure 2:
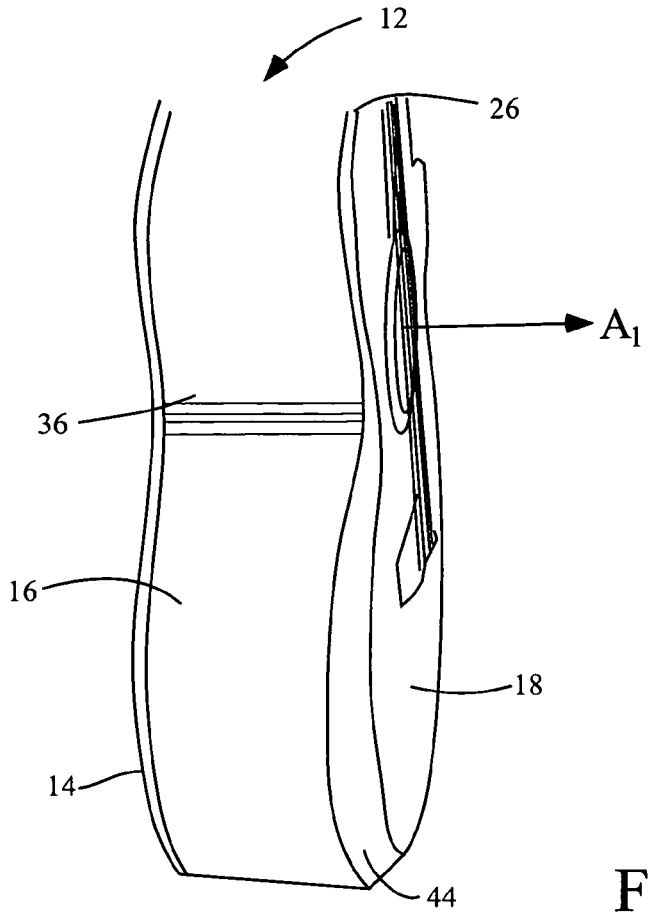
FIG. 2 shows a side view of the musical shown in FIG. 1, viewed from the bass side.
Figure 3:
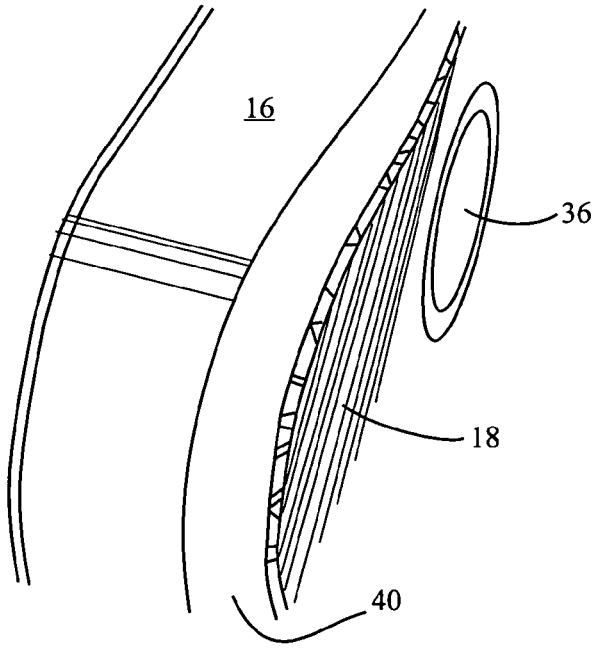
FIG. 3 shows a closer view of the bevel, showing how the bevel forms a transition zone from the side of the instrument to the soundboard of the instrument.

Referring now to the figures, FIGS. 1-3 shows a musical instrument, such as a flat-topped guitar 10, having a sound chamber 12 defined by a back 14, sides 16, and a soundboard 18. A neck 20 is attached to the sound chamber 12. A longitudinal axis L is defined by the sound chamber 12 and the neck 20. Guitar 10 further comprises upper bout 22 and lower bout 24, where a waist 36 is defined by the section of transition from the upper bout to the lower bout.

Guitar 10 further comprises a plurality of strings 28 oriented along the longitudinal axis L. The strings 28 extend from the bridge 30 to the tuning machines 32 mounted in the headstock 34 of the instrument. For a right handed six string instrument, when viewed from the front of the instrument as shown in FIG. 1, the three strings 28 on the left side of the instrument are the bass strings and the three strings 28 located on the right side of the instrument are the treble strings. For frame of reference, the side of the guitar 10 closest to the bass strings 28 is referred to herein as the bass side, and the side of the guitar closest to the treble strings 28 is referred to herein as the treble side. It is to be appreciated that while many guitars and other instruments have a number of strings differing from six, the general convention of referring to a bass side and a treble side of a musical instrument will still apply. It is to be further appreciated that the invention described herein is not limited to instruments having only six strings, but may include other available configurations, such as four string, seven string, eight string, and twelve string instruments.

On most flat-topped acoustic guitars, the soundboard 18 comprises a sound hole 50 which underlies the strings 28.

Figure 4:
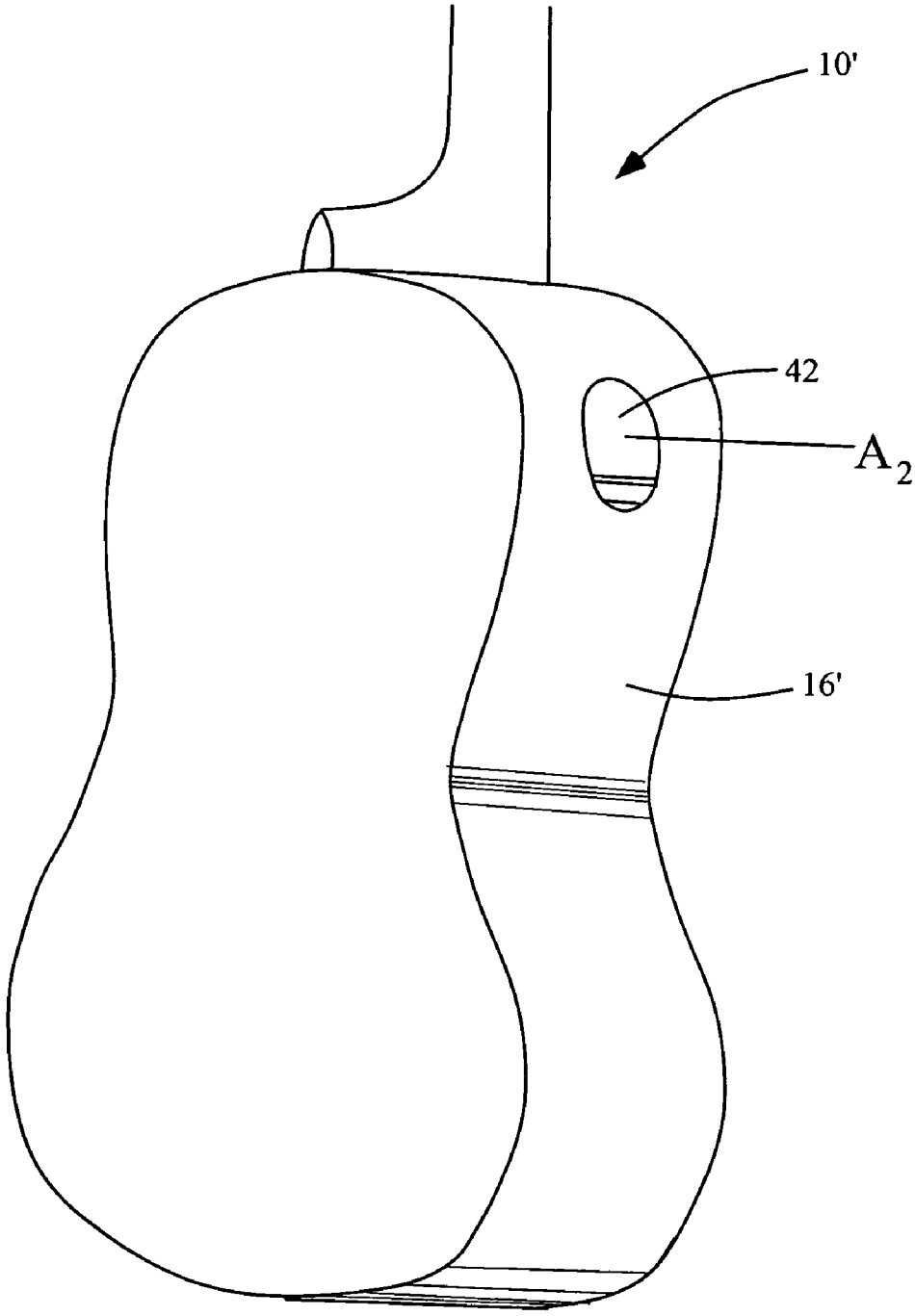
FIG. 4 shows a prior art sound port which is placed in the side of the instrument in the upper bout.

Sound hole 50 provides an area of emission for the sound waves generated by the strings 28 as amplified by the sound chamber 12. As illustrated in FIG. 2, sound hole 50 defines an axis $A_1$ which, for most guitars, extends directly outward from the soundboard 18, such that the axis $A_1$ of the sound hole is perpendicular to a plane defined by the soundboard. As shown in FIG. 4, it is known to place one or more soundports 42 in the sides 16' of a guitar 10'. For the soundport 42 illustrated in FIG. 4, it may be seen that an axis $A_2$ of the soundport 42 would be at a right angle to the axis $A_1$ defined by the sound hole 50. Because of this configuration of the soundport 42, sound waves emitted through the port will be directly upwardly generally toward the ceiling, rather than outwardly toward a listener who may be located in front of the instrument.

As can be seen from the illustration of FIG. 4, soundport 42 has a significant cross-sectional area with respect to the side 16' of the guitar, such that the loss of cross-sectional area can impact the structural strength of the guitar 10'. Therefore, reinforcement of the side 16' may be required for the instrument to withstand the loads imposed by the strings when brought to correct tension.

Returning to FIGS. 1-3, a mutual edge 26 is defined where the soundboard 18 joins the sides 16. For most guitars, the sides 16 are generally at a right angle to the soundboard 18. The mutual edge 26 may have a binding 38 which extends around the perimeter of the instrument. The binding 38 may comprise wood, plastic, or other trim materials, which protect the soundboard and side from impact damage. The mutual edge 26 may include a portion which has been rounded or beveled such that, at this beveled portion, there is no longer a right angle between the side 16 and the soundboard 18. This beveled portion is herein after referred to as the bevel 40.

For the bevel 40 produced by the inventor herein (the "Ryan bevel"), the bevel feathers in just above the bass-side waist 36 and feathers out just beyond the centerline of the guitar at the tailblock area 44. The Ryan bevel 40 generally comprises an approximate 45 degree chamfer on the bass side lower bout 24. The Ryan bevel 40 has some acoustic advantages but it also creates greater comfort for the player since the player's arm (typically the right arm) is resting on a chamfered, wide surface rather than against the relatively sharp corner of the guitar where the sides and soundboard of a conventional acoustic guitar meet. FIG. 1 shows a front view of a guitar having the Ryan bevel, and FIG. 2 shows a side view of the Ryan bevel.

Figure 5:
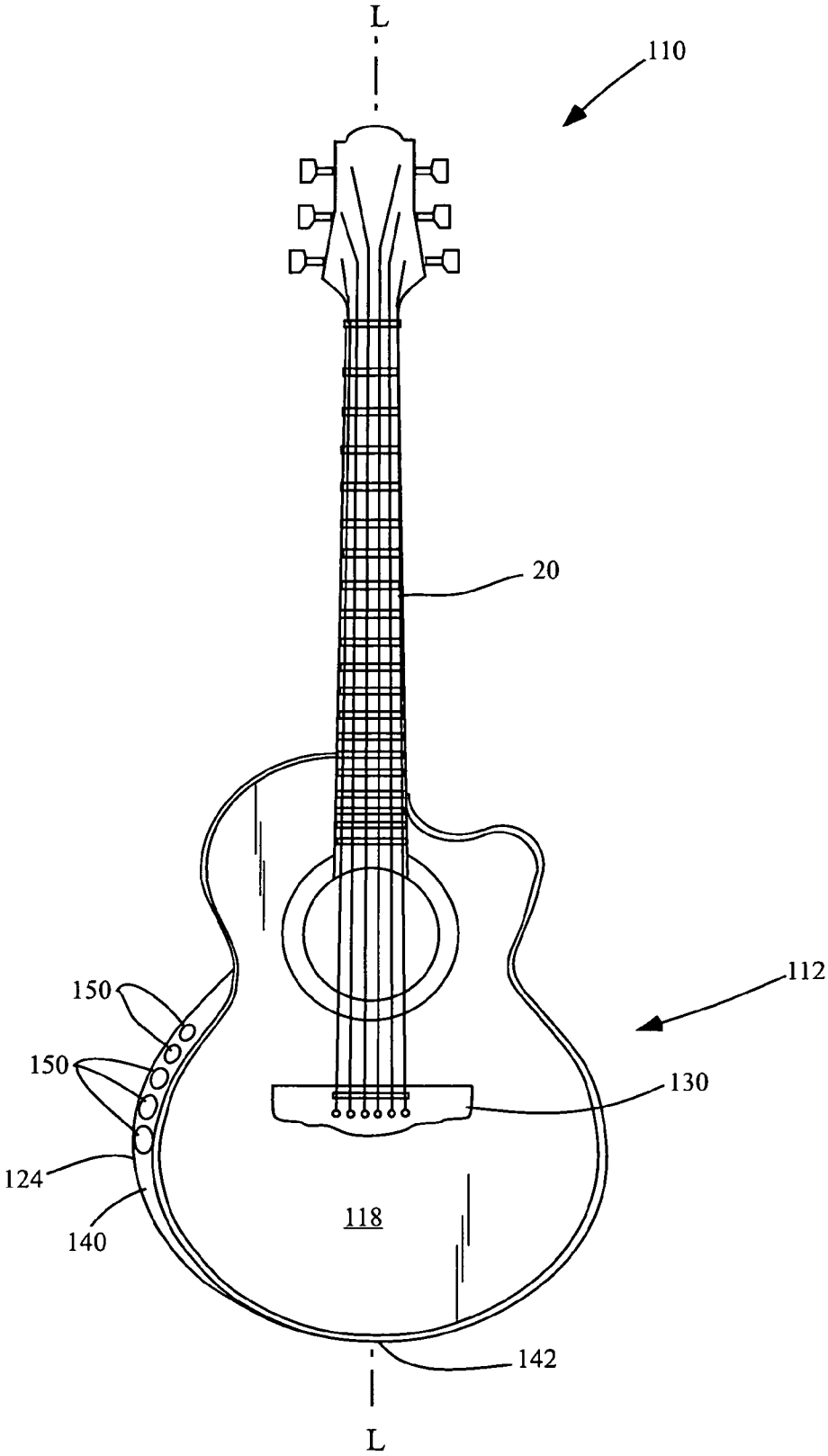
FIG. 5 shows a front view of a musical instrument having an embodiment of the ported bevel of the present invention.
Figure 6:
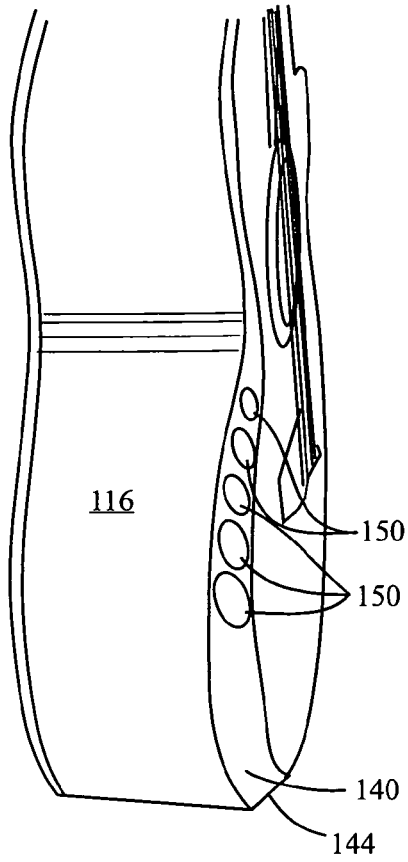
FIG. 6 shows a side view of the musical instrument shown in FIG. 5, viewed from the bass side.
Figure 7:
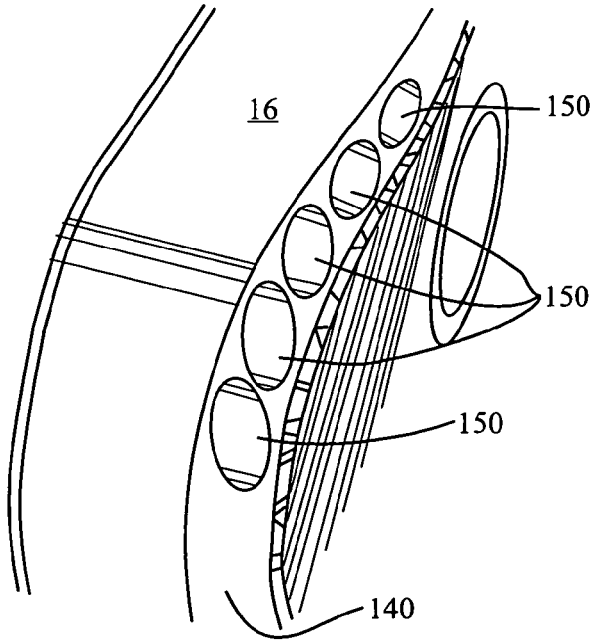
FIG. 7 shows a closer view of the fluted bevel shown in FIG. 5.

Referring now to FIGS. 5-7, an embodiment of the present invention comprises an instrument, such as guitar 110, having the same general structural features as discussed above with respect to FIGS. 1-3. Guitar 110 comprises a bevel 140 in the lower bout 124 of the instrument, wherein the bevel is essentially the same as bevel 40 described above except for the improvements discussed hereafter. For the present invention, one or more flutes 150 are constructed within the bevel 140, wherein the flutes comprise one or more small openings which penetrate through the face of the bevel 140 and extend through the bevel into the sound chamber. Because the bevel 140 is not at a right angle to the soundboard 118, the axis of the flutes 150 are at an angle of less than ninety degrees to the soundboard, thereby directing sound waves more toward the audience than soundports 42 disposed in the sides 16' of an instrument 10', such as that shown in FIG. 4. Depending upon the playing position of the musician, this feature directs the sound waves more toward the player's ear than a soundport disposed in the upper bout of the instrument.

Figure 8:
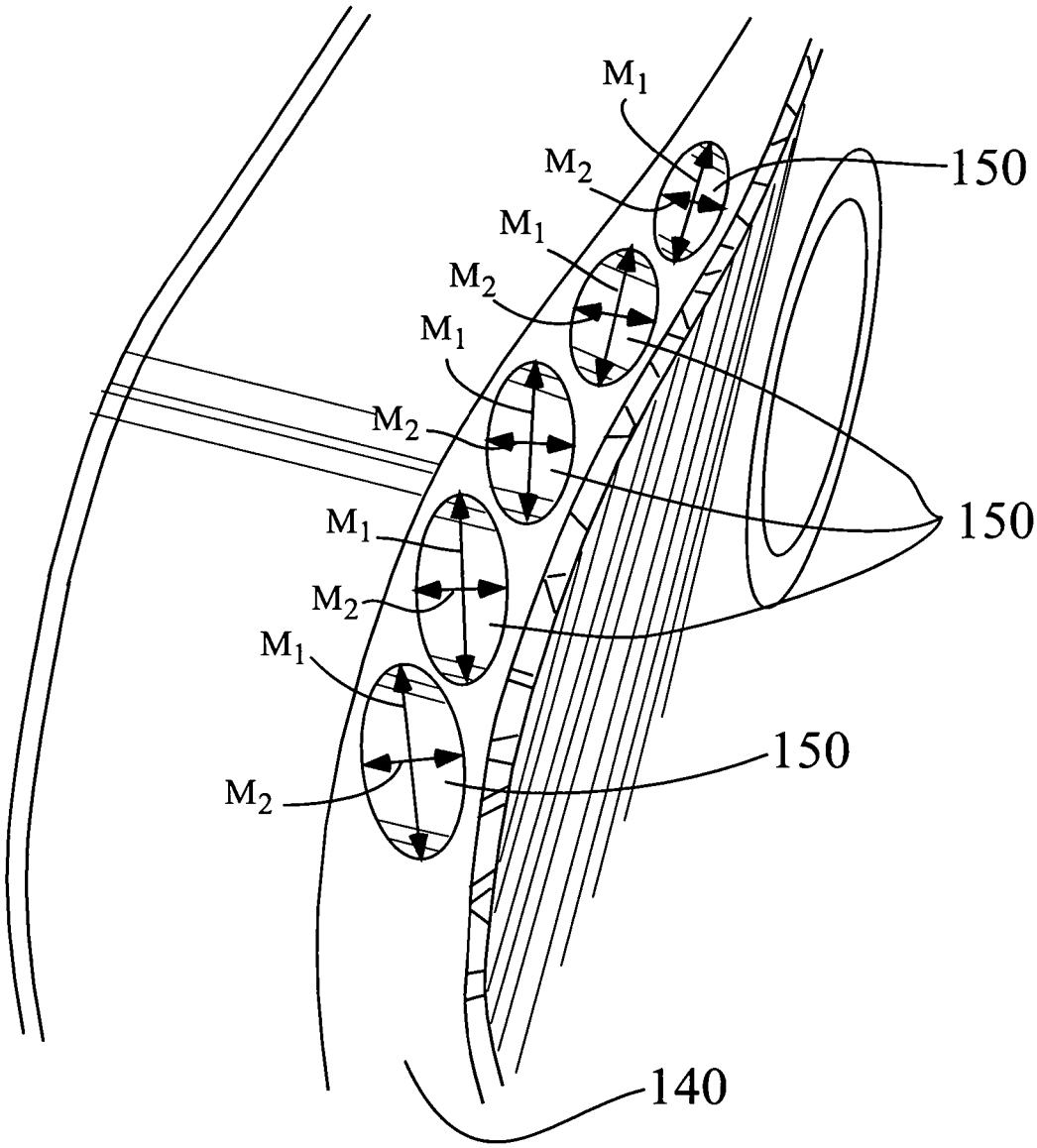
FIG. 8 shows a detailed view of the fluted bevel of FIG. 7, illustrating how the flutes may comprise elliptical cross-sections having a major and a minor axes.

Embodiments of the flutes 150 are shown in FIGS. 5-8. As shown in these Figures, the flutes 150 may comprise elliptical openings. As best shown in FIGS. 6-8, as a plurality of flutes 150 approach the tail block 144, the dimensions of the openings may increase, which is made possible by the increased width of the bevel 140 as it transitions toward the tail block. This placement of the flutes creates an aesthetically pleasing appearance as the flutes are set forth in a shape defined by the curve of the bevel 140.

As shown in FIG. 8, flutes 150 having an elliptical cross-section may define a major axis $M_1$ and a minor axis $M_2$. For a plurality of elliptically-shaped flutes 150 placed within bevel 140, the orientation of the minor axis $M_2$ and major axis $M_1$ for each opening may change with respect to the major axis and minor axis of an adjacent flute disposed within the bevel, thereby providing the ability to impact the directionality of the sound waves propagating through the flutes, and thereby focus the sound waves toward the ear of the player and/or toward the audience. This configuration of the flutes 150 is also visually pleasing. The placement of the flutes 150 in the bevel 140 provides another benefit. Because the flutes 150 are placed near where the player's arm naturally rests on the instrument while playing, the player can easily create a pleasing "tremolo" effect by alternately covering and uncovering one or more flutes with the player's arm.

The Ryan bevel is the preferred bevel 140 for placement of the flutes 150. Because the Ryan bevel generally has a wall thickness greater than 0.20", the concerns of adversely impacting the structural integrity of the sound chamber are greatly diminished, thereby eliminating the need for additional weight on the guitar and the labor to install any reinforcement structure. Flutes 150 in the Ryan bevel 140 are located in the an area of the sound chamber which is directly across from the most acoustically active area of the soundboard, adjacent to the bridge 130. This location maximizes the impact and effect of the sound to the ears of the player.

Flutes 150 may be created by milling or cutting the flutes into a sound chamber 112 having an existing structure suitable for placement of the flutes. As discussed above, this structure should have greater wall thickness than the sides of the instrument, and should allow for focusing the axis of the flute in a direction that is not generally perpendicular to the soundboard 118 of the instrument. The flutes 150 should be milled before the gloss finish is applied. The preferred tool for creating the flutes is a cutting head or drill bit driven by a hand-held air turbine motor spinning at approximately 40,000 rpm. The high-speed of the motor is necessary to achieve a clean, crisp edge on the flutes 150 without chipping or tear-out of the wood grain.

The method of installing the flutes 150 in the bevel 140 may include the preparation of a template which is placed upon the bevel such that the orientation and relative positions of a plurality of flutes may be consistent from one instrument to another.

While the above is a description of various embodiments of the present invention, further modifications may be employed without departing from the spirit and scope of the present invention. Thus the scope of the invention should not be limited according to these factors, but according to the following claims.

What is claimed is:

1. A bevel for a musical instrument, the musical instrument having a sound chamber defined by a back, sides, and a soundboard, a neck attached to the sound chamber wherein a longitudinal axis is defined by the sound chamber and the neck, the musical instrument further comprising an upper and lower bout, where a mutual edge is defined where the soundboard abuts the sides, the musical instrument further comprising a plurality of strings, including bass strings and treble strings, the strings positioned above the soundboard and oriented along the longitudinal axis, wherein the side of the musical instrument adjacent to the bass strings is defined as the bass side, wherein a portion of the mutual edge in the lower bout of the bass side comprises a rounded transition member between the side and the soundboard, the rounded transition member comprising the bevel, the bevel comprising an opening which extends through the bevel into the sound chamber.

2. The bevel of claim 1 wherein the musical instrument comprises a waist defined by the transition from the upper bout to the lower bout, wherein the sound chamber comprises a bottom in alignment with the longitudinal axis, wherein the bevel is fashioned between the waist and the bottom.

3. The bevel of claim 2 wherein the bevel comprises a plurality of openings.

4. The bevel of claim 3 wherein the openings have elliptical cross-sections.

5. The bevel of claim 4 wherein a first opening comprises a first elliptical cross-section having a first major axis and a first minor axis, and a second opening comprises a second elliptical cross-section having a second major axis and a second minor axis, wherein the first major axis is not parallel with the second major axis and the first minor axis is not parallel with the second minor axis.

6. The bevel of claim 3 wherein the cross-sectional areas of the openings progressively increase from a first portion of the bevel adjacent to the waist to a second portion of the bevel adjacent to the bottom.

7. The bevel of claim 1 wherein the soundboard defines a plane, and the musical instrument comprises a sound hole defining a first central axis perpendicular to the plane of the soundboard.

8. The bevel of claim 7 wherein the opening in the bevel defines a second central axis, wherein an angle is defined between the first central axis and the second central axis, and the angle is less than ninety degrees.

9. The bevel of claim 1 wherein the bevel comprises an approximate 45 degree chamfer on the bass side of the lower bout.

10. The bevel of claim 3 wherein the plurality of openings comprises 5 openings.

11. The bevel of claim 10 wherein each of the openings has an elliptical cross-section.

12. The bevel of claim 11 wherein the cross-sectional areas of the openings progressively increase from a first portion of the bevel adjacent to the waist to a second portion of the bevel adjacent to the bottom.

13. A method of installing flutes in a bevel member to be disposed within a musical instrument, the musical instrument comprising a sound chamber defined by a back, sides, and a soundboard, a neck attached to the sound chamber wherein a longitudinal axis is defined by the sound chamber and the neck, the musical instrument further comprising an upper and lower bout, where a mutual edge is defined where the soundboard joins the sides, the musical instrument further comprising a plurality of strings including bass and treble, positioned above the soundboard and oriented along the longitudinal axis, the side of the musical instrument adjacent to the bass strings defined as the bass side, wherein a portion of the mutual edge in the lower bout of the bass side comprises a rounded transition portion from the side to the soundboard, the rounded transition portion comprising the bevel member, the method comprising the steps of:

placing a cutting head of a hand-held air turbine against the exterior unfinished surface of the bevel member;

orienting the cutting head such that an axis defined by the cutting head is not perpendicular to the soundboard; and activating the hand-held turbine motor to spin at approximately 40,000 rpm and cutting an opening which extends through the bevel member into the sound chamber.

* * * * *